US005224240A

United States Patent [19]

Smith et al.

[11] Patent Number: 5,224,240

[45] Date of Patent: Jul. 6, 1993

[54] HINGE MASKING DEVICE AND METHOD

[76] Inventors: David C. Smith, 120 Delwyn La., Collings Lakes, N.J. 08094; Albert Braig, 5348 Gloucester Rd., High Ridge, Mo. 63049; Alfred J. Bannister, R.D. 2 179U Blue Bell Rd., Franklinville, N.J. 08322

[21] Appl. No.: 863,944

[22] Filed: Apr. 6, 1992

Related U.S. Application Data

[63] Continuation-in-part of Ser. No. 731,141, Jul. 15, 1991, abandoned.

[51] Int. Cl.[5] ..... E05D 11/00; B05C 11/11

[52] U.S. Cl. ..... 16/251; 16/250; 118/505

[58] Field of Search ..... 16/250, 251; 118/505

[56] References Cited

U.S. PATENT DOCUMENTS

| | | | |
|---|---|---|---|
| 2,274,160 | 2/1942 | Porter . | |
| 2,342,453 | 2/1944 | Colucci . | |
| 2,628,125 | 2/1953 | Jacobs | 296/97 |
| 3,422,486 | 1/1969 | Thomas, Jr. . | |
| 4,195,590 | 4/1980 | Herrington | 118/505 |
| 4,570,291 | 2/1986 | Smith et al. | 16/250 |
| 4,691,409 | 9/1987 | Torgerson et al. | 16/250 |
| 4,802,259 | 2/1989 | Geslewitz | 16/251 |
| 5,056,191 | 10/1991 | Love | 16/251 |

*Primary Examiner*—James F. Coan
*Assistant Examiner*—Carmine Cuda
*Attorney, Agent, or Firm*—Thomas A. Lennox

[57] ABSTRACT

A half hinge paint masking cover for doors, and/or door frames is provided as a one piece body molded of a rigid thermoplastic resin. The device includes two molded half cavities each cavity being connected by a thin flexible membrane of the molded material. The first cavity area covers the back surface area of the hinge barrel and has two half end shields each of which cover half the edge area of the hinge barrel and the exposed edge area of the hinge plate. The second cavity half covers the front surface half of the hinge barrel and has two end shields which cover half the edge area of the hinge barrel. A portion connected to the second cavity half includes a long flat area which covers the exposed face side of the hinge plate. The two half cavities are secured to each other by folding along the flexible membrane and engulfing the door or frame half hinge until pins projecting from tops on one half engage and protrude through holes which are located on tabs on the other half.

6 Claims, 3 Drawing Sheets

HINGE MASKING DEVICE AND METHOD

This application is a continuation-in-part of application Ser. No. 07/731,141 filed Jul. 15, 1991, now abandoned.

BACKGROUND OF THE INVENTION

This invention involves a masking device and the method for using it to cover a hinge half attached to a door or door frame while the surrounding areas are being coated with paint or other surface preparations.

During painting, staining, waxing and similar finishing operations to doors and door frames, it is commonly desired to prevent these coatings from coming in contact with the exposed areas of the hinge halves. It is often required to either shield the hinge halves or remove them entirely until the finishing operations are complete. One method practiced is to remove the door from its frame and to use masking tape and a sharp knife to trim the tape close to the exposed area of each hinge half. Another method practiced is to remove the door from its frame and then remove the hinge fasteners and the hinge halves completely from the door and door frame area. The old method then requires reinstalling the hinge halves after the finishing operations are completed. Both of these methods are objectionable because of the resultant low productivity. Often residual glue or adhesive left over from the taping operation requires a solvent wiping step to completely remove this residue from the exposed areas of the hinge halves. Removing and reinstalling hinge halves adds to the risk of damaging the newly finished door and door frames due to the amount of additional handling and tool usage required to perform the task. Further, hinges that are completely removed and reinstalled later run the risk of mix ups in hinge placement which could prevent proper operation when articulating the door.

Other present day masking devices are used when the door is left in place. These devices only cover the barrel portion of the hinge, and still depend on masking tape or its like to shield flat hinge plate area and its edges. No single device is available that shields both the flat hinge plate area, its edges, and the barrel area of a half hinge which is left mounted to a door or a door frame. None of the prior art devices attain the objects described herein below.

SUMMARY OF INVENTION

A basic object of the invention is to provide a device and method for mask protecting a door or door frame hinge half.

Another object of the invention is to provide a device which can be quickly installed without the use of adhesives, fasteners, tape or clamps.

A further object of the invention is to provide a device which can hold its self in place by the contracting tension forces and or the elastic memory of the material it is molded from.

A specific object of the present invention is to provide a device which is premolded from recyclable thermoplastic resin.

Another object of the invention is to provide a device that can be quickly removed from the hinge half without the use of tools, and is reusable several times over.

A specific object of the present invention is to provide a masking device of one piece construction.

An object of the invention is to provide an inexpensive covering device for premounted door and door frame half hinges during painting, staining, and similar operations.

Another object of the invention is to provide a one piece part which is capable of being used on either the door half, or the door frame half to shield the exposed areas of the mounted half hinge.

The hinge protector is a one piece molded device which is self adhering to a hinge half without the use of adhesives, adhesive tapes, fasteners or external clamping devices. It serves as a protective mask which shields the normally exposed area of the hinge half during door and door frame finishing operations. A device uses the elastic and tension force characteristics of the synthetic material it is made from to hold itself in place during its period of service.

In the present invention in which a hinge half protector device is of a one piece construction, the premolded shape of the protector allows for an easy snap in place application or removal of the device. It engulfs the normally exposed hinge areas and shields them against coatings which are applied to the door and door frame areas as part of its finishing. A device is molded from a synthetic plastic resin which can be either of the rigid or semi-rigid type.

In another aspect of the invention, a device is provided with two rigid cavities connected via a thin membrane area. One cavity has a large plate area from which extend two tab areas. Each of these tabs have a small protruding pin. The other cavity has a somewhat smaller flat area, plus two side shield areas and two tab areas, each tab having a slotted hole. The position of the hole tabs may be switched with that of the pin tabs. When the hinge paint cover is folded along the membrane area the two cavity areas form a shield around the hinge barrel. As the two cavities come together, the pins on the one set of tabs engage the holes on the other set of tabs. The interference fit between the pins and the holes holds the two flat areas together and keeps the hinge paint cover in place. Once the pins are engaged, the entire exposed hinge half is covered. This includes both sides of the hinge plate, its edges, the hinge barrel, and its edges. By grasping the long flat area and pulling away from the short flat area the paint cover can be easily removed.

An aspect of the invention is a door hinge protection device to mask a half-hinge that is attached into a surface of either a door or a door frame, the half-hinge having a portion of the barrel that projects outwardly from the surface and an integral hinge plate with a thickness imbedded in the surface leaving exposed a first face surface of the hinge plate and a portion of a second opposite face surface of the hinge plate. The device is an integral unit that includes an elongate cylindrical body that has an internal cavity of a size and shape sufficient to enclose the barrel portion of the half-hinge. The cylindrical body has a cylindrical wall of an elongate length and two end closure walls. The device also includes a lengthwise opening through a side of the cylindrical body forming an upper lengthwise edge on one side of the opening and lower lengthwise edge along the opposing side of the opening. The device further includes a first cover panel attached along the upper lengthwise edge extending radially outwardly from the cylindrical body, the first cover panel of a size and shape to cover the exposed portion of the second face surface of the hinge plate. The device also includes a second cover panel attached along the lower lengthwise edge extending radially outwardly from the cylindrical body, the second cover panel of a size and shape to cover the exposed first face surface of the hinge plate. The device further includes opening means to allow widening of the lengthwise opening sufficient to allow the cylindrical body to be engaged over and enclose the barrel portion of the half-hinge, and closure means to hold the cylindrical body around the barrel portion and the cover panels against the exposed face surfaces of the hinge plate.

A preferred embodiment of the device has the opening means including two slit cuts through the two end closure walls along upper corners between the first cover panel and the cylindrical body, the slit cuts continuing circumferentially at least partially around and through an outside corner between the end closure walls and the cylindrical body. In this embodiment the closure means includes a space between the first and second cover panels less than the thickness of the hinge plate and a combination of wall thickness of the cylindrical body and flexural modulus and elastic memory of material composition of the device sufficient to urge the cover panels into contact with the exposed surface of the hinge plate. A preferred embodiment provides that the opening means include two slit cuts through the two end closure walls extending from ends of the lengthwise opening across the two end closure walls terminating at points on the cylindrical wall, and an integral hinge extending lengthwise along the cylindrical wall between the points. It is preferred that the closure means include a male projection extending proximately from one side of the extended lengthwise opening and a complimentary female opening on an opposite side of the extended lengthwise opening sized and positioned to receive and hold the male projection. It is preferred that the slit cuts bisect the two end closure walls.

Another aspect of the invention is a paint masking device to cover a mounted half-hinge with an exposed barrel portion and a partially exposed hinge plate. The device being an integral molding includes a first lengthwise half cylindrical housing of a shape to cover half of the hinge barrel, and a second lengthwise half cylindrical housing of a shape to cover a remaining half of the hinge barrel. The device further includes a hingeable membrane attachment of the half cylindrical housings along adjacent lengthwise edges, and panels extending from lengthwise edges of sufficient size and shape to cover exposed surfaces of the hinge plate. The device also includes complimentary pairs of tabs projecting from opposite ends of the panels proximate ends of the half cylindrical housings, one tab of each pair comprising a male projection and a remaining tab of each pair comprising a hole, wherein the position, size and shape of the mating holes and male projections provide an interference fit to hold the half cylindrical housings together covering the hinge barrel portion and the panels against the exposed hinge plate surfaces.

Yet another aspect of the invention is a method to mask a half-hinge attached into a surface of either a door or a door frame, the half-hinge having a portion of the barrel that projects outwardly from the surface and an integral hinge plate with a thickness inlaid in the surface leaving exposed a first face surface of the hinge plate and a portion a second opposite face surface of the hinge plate. The method includes providing one of the devices described hereinabove. The method further includes operating the opening means to widen the lengthwise opening and engaging the elongate cylindrical body over the barrel portion with the cover panels facing their respective face surfaces of the hinge plate. The method then includes operating the closure means to hold the cylindrical body around the barrel portion and the cover panels against the exposed face surfaces of the hinge plate, and then coating the surface of either the door or the door frame with a chosen surface preparation. The method then includes releasing the closure means, and removing the device from the half-hinge.

DESCRIPTION OF PREFERRED EMBODIMENTS

The half hinge paint cover includes two cavities, two flat areas, two edge shields, and four tabs of which two have slots and two have pins. The half hinge paint cover is a one piece molded rigid thermoplastic material which has integral portions arranged so that their shapes conform to that of a standard interior half door hinge. By placing the cavity with the short flat area against the inboard side of a mounted half hinge and bending it along the membrane area, the cavity portion will then cover a portion of the hinge barrel area and the exposed back portion of the hinge plate. The cavity will cover the remaining portion of the hinge barrel and the exposed hinge plate area will be covered. The normally exposed edges of the half hinge are covered by the end walls. Applying a slight amount of finger pressure to corresponding tabs, will allow the pins to engage and protrude from the slotted holes. The vertical interference fit between pins and the slotted holes creates sufficient tension forces needed to hold the two cavity halves together. The horizontal clearance between pins and the slotted holes allows a small amount of lateral movement of cavities in relationship to each other so as to allow for common differences in mounting locations of half hinges of either a door or a door frame.

The half hinge protective illustrated in the figures are used on either the premounted half hinge of a door or a door frame. The intended use is for standard prehung unfinished doors and frames used in new home construction or when refinishing doors and/or the frame moldings. A device snaps in place due to two slits, which run from the leading edge of the top short edge area along the top edge corners to the right of vertical when viewing the sides. Because the material used to mold this invention is a ductile thermoplastic resin it will flex to increase the gap when pressure is applied to open the top. The natural memory in the area surrounding the hinge barrel will allow the short top edge area to return to it's molded position thus creating a small amount of compression force capable of holding itself in place. The large bottom area is designed to cover the plate area and shape of a standard hinge. The top edge area covers the short exposed area of premounted hinge half. The cylindrically shaped area covers the round barrel pivot area of a hinge half and the sides cover the edges of a hinge half which are not inlaid into a door or door frame.

Figure 1:
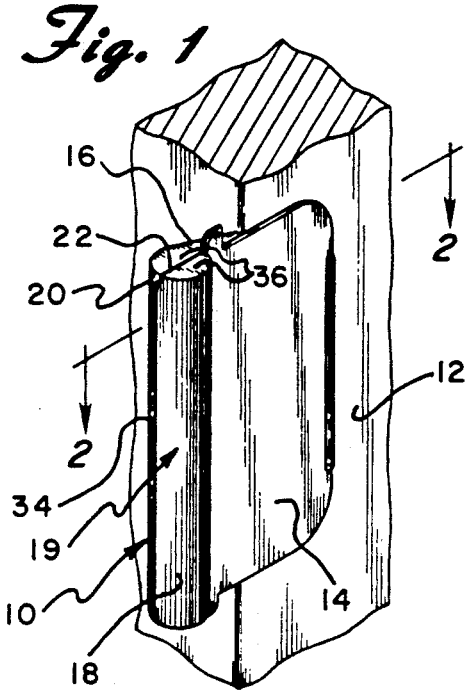
FIG. 1 is a perspective view of a device of the present invention in covering a half hinge on a door or a door frame.
Figure 2:
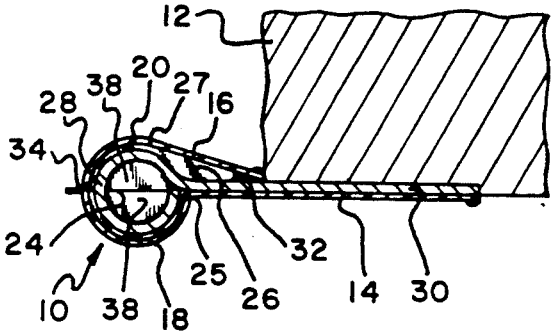
FIG. 2 is a cross sectional view taken along lines 2—2 of FIG. 1.
Figure 3:
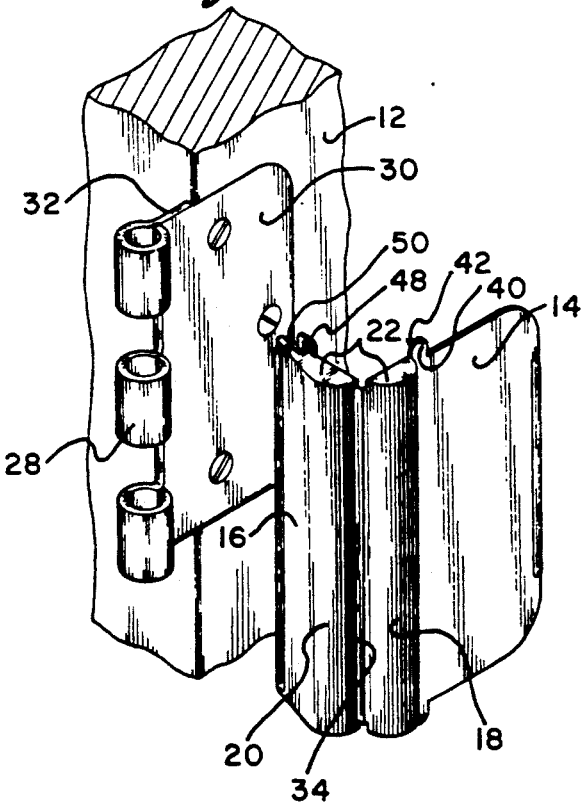
FIG. 3 is a perspective view of the device illustrated in FIG. 1 opened and removed from the half hinge.
Figure 4:
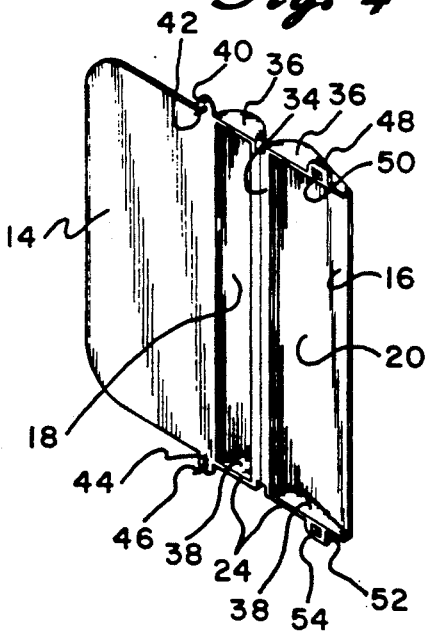
FIG. 4 is a perspective view of the top and inside of the device illustrated in FIGS. 1–3.
Figure 5:
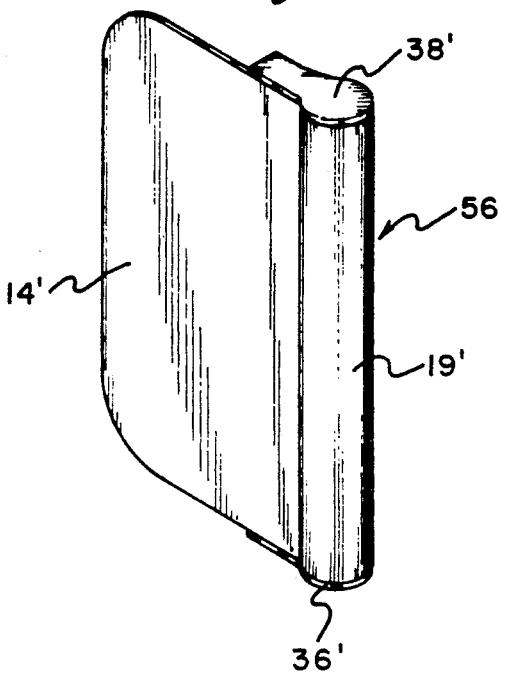
FIG. 5 is a perspective view of a second embodiment of the present invention.
Figure 6:
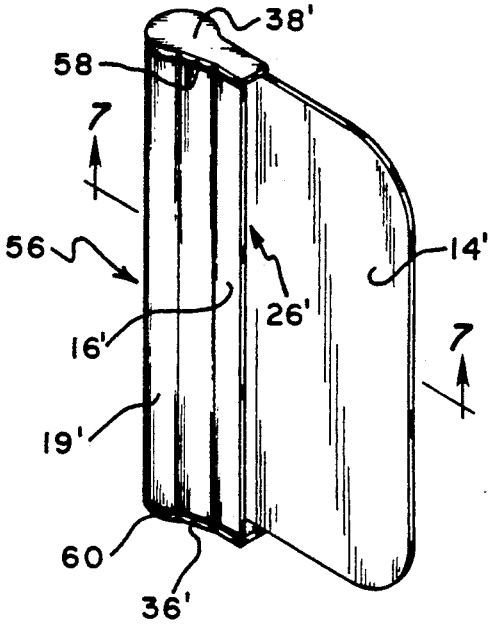
FIG. 6 is a perspective view from the opposite side of the device illustrated in FIG. 5.
Figure 7:
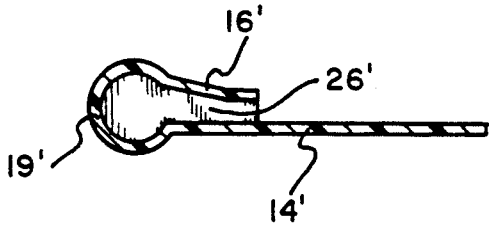
FIG. 7 is a cross sectional view taken along lines 7—7 of FIG. 6.

Masking device 10 is illustrated in FIGS. 1 through 4 shown covering a half hinge inlaid into wood surface 12 as shown in FIG. 1. Device 10 includes large panel 14 which covers surface 30 of the hinge plate and panel 16 which covers surface 32 of the opposite side of the hinge plate, it being mostly inlaid into the wood. Device 10 also includes a cylindrical body divided into one-half cylindrical body 18 and one-half cylindrical body 20, which together make up cylindrical body 19. Lengthwise opening 26 opens lengthwise along the cylindrical body while extension cuts 22 and 24 bisect the closed end shields of the cylindrical body. Panel 14 extends from edge 25 on one side of opening 26 and panel 16 extends outwardly, generally radially from edge 27 of opening 26. The portion of hinge barrel 28 on this hinge half is enclosed by cylindrical body 19 formed from halves 18 and 20. The two halves of the cylindrical body are attached by lengthwise life time hinge attachment 34 which is part of the integral thermoplastic polymer molding of the device. The cylindrical body is closed by end closure wall shield 36 on one end and end closure wall shield 38, each of these walls being bisected by dividing cuts 22 and 24 respectively. With lengthwise hinge attachment 34 cylindrical body opens like a clam shell to allow easy insertion over hinge barrel 28 placing panels 14 and 16 over and covering the respective hinge plate surfaces. Device 10 is held onto the hinge by a series of snap closures which attach the two sides together and hold them on the half hinge. Tabs 40 and 44 extend outwardly, generally in the same plane as panel 14 normal to end walls 36 and 38 respectively. Male snap pins 42 and 46 are molded normal to tabs 40 and 44 respectively, both extending away from the concave shape of the cylindrical body half 18. Complimentary tabs 48 and 52 are molded generally in the same plane as panel 16 extending normally from end walls 36 and 38 respectively. These tabs are positioned such that they are adjacent to tabs 40 and 44 when the cylindrical body is closed. Holes 50 and 52 are elongated openings sized to snugly fit or even snap fit insertions of male pins 42 and 46 to hold the device together. When the device is to be removed, lifting at the end of large panel 14 will disengage pins 42 and 44 from holes 48 and 54 respectively allowing easy removal of the device.

Suitable polymers for molding device 10 as an integral body include high density polyethylene, polypropylene, acrylonitrile styrene copolymer, acrylonitrile butadiene styrene copolymers, acetal, nylons, and other rigid and semi-rigid thermoplastic polymers which lend themselves to injection molding of the device.

Figure 8:
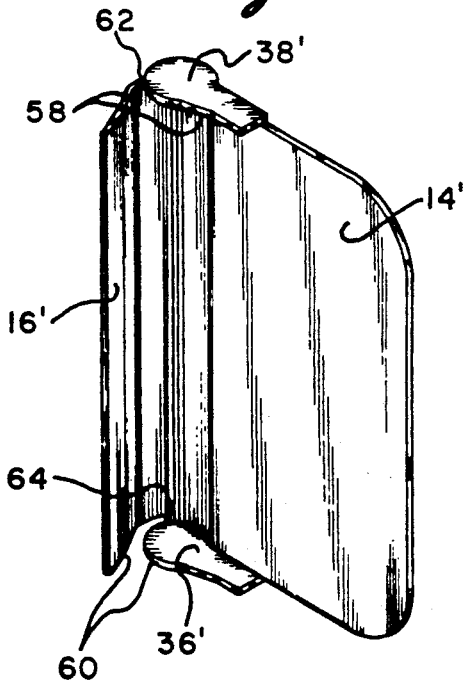
FIG. 8 is a perspective view of the device illustrated in FIG. 6 flexed to open for insertion on a door or door frame.

Masking device 56 is illustrated in FIGS. 5 through 8 again molded from a thermoplastic polymer, specifically chosen to have a flexural modulus of elasticity and ductility sufficient to provide good memory to allow it to return to its original shape after some deformation in flexure. For those parts of this embodiment that are similar in structure to that of device 10, those parts are designated with a "prime". Device 56 includes cylindrical body 19' with lengthwise opening 26' extending end to end. The body is closed at each end by end closure walls 36' and 38'. Cover panel 14' extends radially from the edge of opening 26' to cover hinge plate 30 while cover panel 16' extends radially from the opposite adjacent edge of opening 26' again generally radially to cover exposed surface 32 of the hinge plate. Since opening 26' is not sufficient to allow body 19' to engage barrel portion 28 of the half hinge, it is necessary to provide an opening means in the form of two slits together with the physical characteristics and thickness of the plastic molding to provide an elastic recovery. Slit 58 extends from the outer edge of panel 16' along the corner between it and end wall 38' extending the full edge of panel 16' circumferentially around body 19' about half way to point 62. Likewise, slit 60 extends from the leading edge of panel 16 along the corner between that panel and end wall 36' around the body about half way. As illustrated in FIG. 8, panel 16' has been opened somewhat wider than necessary to illustrate slits 58 and 60 as they operate to widen lengthwise opening 26'. Although not shown in the figures, the wall thickness of cylindrical body 19' may vary as to the position on the circumference to provide sufficient rigidity and recovery to avoid strain of the polymer upon opening and widening opening 26' to insert the device on to the half hinge.

Figure 9:
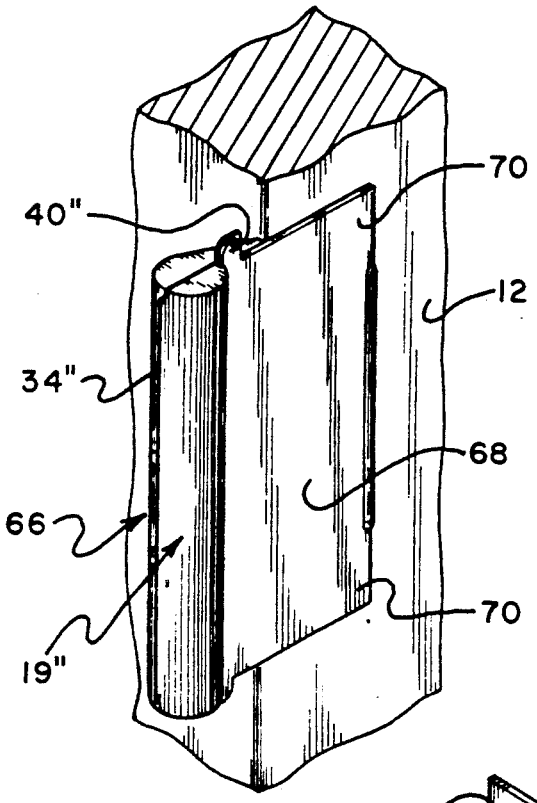
FIG. 9 is a perspective view of a third embodiment of the present invention covering a half hinge on a door or a door frame.
Figure 10:
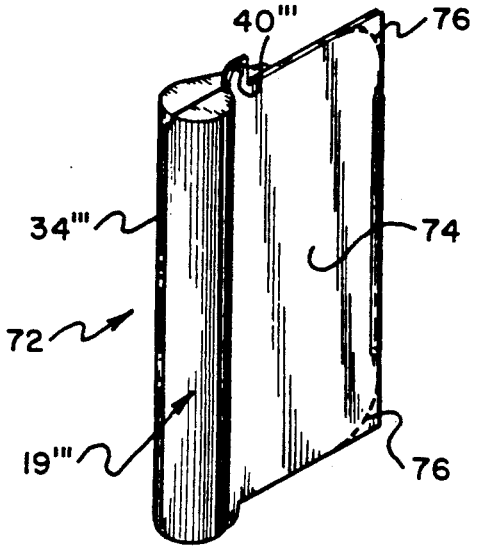
FIG. 10 is a perspective view of a fourth embodiment of the present invention.
Figure 11:
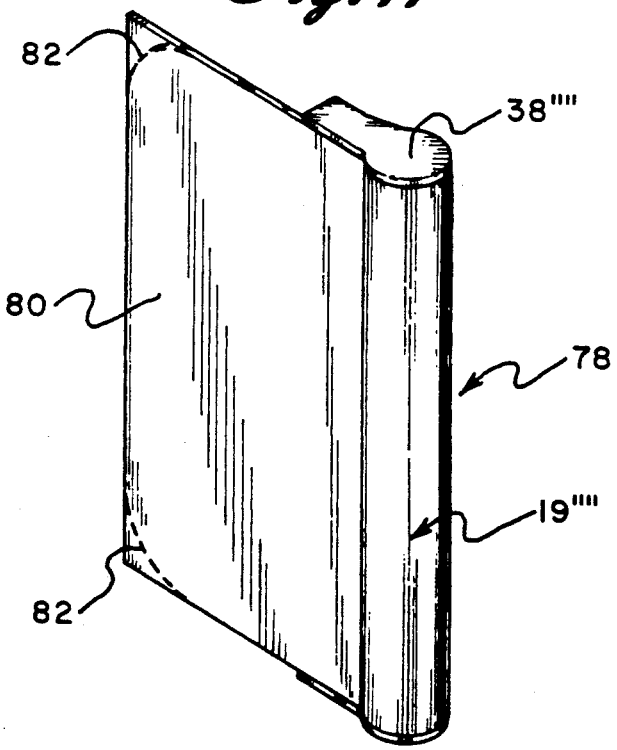
FIG. 11 is a perspective view of a fifth embodiment of the present invention.

Three alternative embodiments are illustrated in FIGS. 9 through 11. Panels 14 and 14' may be re-shaped to any hinge plate shapes. While panel 14 is rounded at the corners, device 66 includes large panel cover 68 which includes square outer corners 70 to cover rectangular hinge plates. Device 72 illustrated in FIG. 10 includes a modified hinge plate cover panel 74 wherein the corners are square but a curved indent 76 is provided on each outer corner to allow easy trimming of the corner to the proper shape if the hinge plates are rounded. Likewise, device 78, which is similar to that of device 56 includes large cover panel 80 again with cut serrations 82 which allow easy trimming of the square corners away to fit round cornered hinge plates.

While this invention has been described with reference to the specific embodiments disclosed herein, it is not confined to the details set forth and the patent is intended to include modifications and changes which may come within and extend from the following claims.

I claim:

1. A door hinge protection device to mask a half-hinge that is attached into a surface of either a door or a door frame, the half-hinge having a portion of the barrel that projects outwardly from the surface and an integral hinge plate with a thickness inlaid in the surface leaving exposed a first face surface of the hinge plate and a portion of a second opposite face surface of the hinge plate, the device being an integral unit comprising:

(a) an elongate cylindrical body comprising an internal cavity of a size and shape sufficient to enclose the barrel portion of the half-hinge, the cylindrical body comprising an elongate length and two end closure walls, (b) a lengthwise opening through a side of the cylindrical body forming an upper lengthwise edge on one side of the opening and a lower lengthwise edge along the opposing side of the opening.

(c) a first cover panel attached along the upper lengthwise edge extending outwardly from the cylindrical body, the first cover panel of a size and shape to cover the exposed portion of the second face surface of the hinge plate.

(d) a second cover panel attached along the lower lengthwise edge extending radially outwardly from the cylindrical body, the second cover panel of a size and shape to cover the exposed first face surface of the hinge plate.

(e) opening means to allow widening of the lengthwise opening sufficient to allow the cylindrical body to be engaged over and enclose the barrel portion of the half-hinge, the opening means comprising:

(i) two slit cuts through the two end closure walls extending from ends of the lengthwise opening across the two end closure walls terminating at points on the cylindrical wall, and (ii) an integral hinge extending lengthwise along the cylindrical wall between the points dividing the cylindrical body into two parts, and (f) closure means to releasably hold the two parts of the cylindrical body around the barrel portion and the cover panels against the exposed face surfaces of the hinge plate, wherein the closure means comprises a male projection extending proximately from one side of the extended lengthwise opening and a complimentary female opening on an opposite side of the extended lengthwise opening sized and positioned to receive and hold the male projection.

2. The device of claim 1 wherein the slit cuts bisect the two end closure walls.

3. The device of claim 1 molded of a rigid thermoplastic polymer

4. A paint masking device to cover a mounted half-hinge with an exposed barrel portion and a partially exposed hinge plate, the device being an integral molding comprising:

(a) a first lengthwise half cylindrical housing of a shape to cover half of the hinge barrel, (b) a second lengthwise half cylindrical housing of a shape to cover a remaining half of the hinge barrel, (c) a hingeable membrane attachment of the half cylindrical housings along adjacent lengthwise edges, (d) panels extending from lengthwise edges of the half cylindrical housings opposite the adjacent lengthwise edges of sufficient size and shape to cover exposed surfaces of the hinge plate, (d) complimentary pairs of tabs projecting from opposite ends of the panels proximate ends of the half cylindrical housings, one tab of each pair comprising a male projection and a remaining tab of each pair comprising a hole, wherein the position, size and shape of the mating holes and male projections provide an interference fit to hold the half cylindrical housings together covering the hinge barrel portion and the panels against the exposed hinge plate surfaces.

5. The device of claim 4 molded of a rigid thermoplastic polymer.

6. A method to mask a half-hinge attached into a surface of either a door or a door frame, the half-hinge having a portion of the barrel that projects outwardly from the surface and an integral hinge plate with a thickness inlaid in the surface leaving exposed a first face surface of the hinge plate and a portion of a second opposite face surface of the hinge plate, the method comprising:

(a) providing an integral unit masking device (i) an elongate cylindrical body comprising an internal cavity of a size and shape sufficient to enclose the barrel portion of the half-hinge, the cylindrical body comprising an elongate length and two end closure walls, (ii) a lengthwise opening through a side of the cylindrical body forming an upper lengthwise edge on one side of the opening and a lower lengthwise edge along the opposing side of the opening, (iii) a first cover panel attached along the upper lengthwise edge extending outwardly from the cylindrical body, the first cover panel of a size and shape to cover the exposed portion of the second face surface of the hinge plate, (iv) a second cover panel attached along the lower lengthwise edge extending radially outwardly from the cylindrical body, the second cover panel of a size and shape to cover the exposed first face surface of the hinge plate, (v) opening means to allow widening of the lengthwise opening sufficient to allow the cylindrical body to be engaged over and enclose the barrel portion of the half-hinge, the opening means comprising:

(A) two slit cuts through the two end closure walls extending from ends of the lengthwise opening across the two end closure walls terminating at points on the cylindrical wall, and (B) an integral hinge extending lengthwise along the cylindrical wall between the points dividing the cylindrical body into two parts, and (vi) closure means to releasably hold the two parts of the cylindrical body around the barrel portion and the cover panels against the exposed face surfaces of the hinge plate, wherein the closure means comprises a male projection extending proximately from one side of the extended lengthwise opening and a complimentary female opening proximate an opposite side of the extended lengthwise opening sized and positioned to receive and hold the male projection, (b) operating the integral hinge to widen the lengthwise opening, (c) engaging the elongate cylindrical body over the barrel portion with the cover panels facing their respective face surfaces of the hinge plate, (d) operating the closure means engaging the male projection into the female opening to hold the cylindrical body around the barrel portion and the cover panels against the exposed face surfaces of the hinge plate, (e) coating the surface of either the door or the door frame with a chosen surface preparation, (f) releasing the closure means, and (g) removing the device from the half-hinge.

* * * * *